US007735378B2

(12) United States Patent
Singfield et al.

(10) Patent No.: US 7,735,378 B2
(45) Date of Patent: Jun. 15, 2010

(54) METHOD TO MEASURE FLOW LINE RETURN FLUID DENSITY AND FLOW RATE

(75) Inventors: Christian Singfield, Shorncliffe (AU); Catalin D. Ivan, Houston, TX (US); Mark Morgan, Houston, TX (US)

(73) Assignees: FSI International Corp Limited, Sandgate (AU); Mezurx Pty Ltd, Spring Hill (AU)

( * ) Notice: Subject to any disclaimer, the term of this patent is extended or adjusted under 35 U.S.C. 154(b) by 53 days.

(21) Appl. No.: 11/959,009

(22) Filed: Dec. 18, 2007

(65) Prior Publication Data

US 2009/0211331 A1 Aug. 27, 2009

(51) Int. Cl.
*G01F 1/00* (2006.01)

(52) U.S. Cl. ..... 73/861

(58) Field of Classification Search ..... None
See application file for complete search history.

(56) References Cited

U.S. PATENT DOCUMENTS 3,934,472 A * 1/1976 Bradham ..... 73/215
4,787,252 A * 11/1988 Jacobson et al. ..... 73/861.28
5,263,370 A * 11/1993 Murata et al. ..... 73/226
5,438,866 A * 8/1995 McQueen ..... 73/204.25
5,786,528 A * 7/1998 Dileo et al. ..... 73/38
5,880,376 A * 3/1999 Sai et al. ..... 73/861.08
6,628,202 B2 * 9/2003 McQueen et al. ..... 340/603
6,997,053 B2 * 2/2006 Forshey et al. ..... 73/296
7,369,949 B2 * 5/2008 Yamamoto ..... 702/45

* cited by examiner

*Primary Examiner*—Harshad Patel
(74) *Attorney, Agent, or Firm*—Edward T. Mickelson; Steve Christian

(57) ABSTRACT

Generally, the present invention is directed to the in situ measurement of fluid density and/or flow rate in tubular conduits, wherein such measurement comprises measuring dynamic fluid level and/or load (weight) in a region of the conduit and correlating these measurements of the fluid with a density and/or flow rate. Such measurements are typically directed toward drilling fluids transported within the tubular conduits—particularly the return flow, wherein the fluid comprises extraneous material (e.g., cuttings, etc.) which can alter the density and flow rate of the drilling fluid.

14 Claims, 4 Drawing Sheets

METHOD TO MEASURE FLOW LINE RETURN FLUID DENSITY AND FLOW RATE

BACKGROUND OF THE INVENTION

1. Field of the Invention

The present invention relates generally to in situ measurement of fluid density and flow rate in pipe; and it relates specifically to methods and apparatus for measuring dynamic fluid level and load (weight) in a region of pipe and correlating these measurements of the fluid with a density and flow rate—with particular applications to return drilling fluid/mud.

2. Background of the Related Art

Drilling fluid, also known as "drilling mud," is used to: (1) remove cuttings from a formation produced by a drill bit at the bottom of a wellbore and carry them to the surface; (2) lubricate and cool the drill bit during operation; and (3) maintain hydrostatic equilibrium so that fluids and gas from the formation do not enter the wellbore in an uncontrolled manner causing the well to flow, kick or blow out. In all such roles, but particularly the latter one, a knowledge of the density and flow rate of the drilling fluid is critical.

Current methods to measure flow rate of a return drilling fluid typically involve inference from the initial pump rate—precluding the ability to monitor the flow rate differential between the initial and return fluid. Moreover, current methods for measuring return drilling fluid density are typically indirect, ex situ techniques. See, e.g., American Petroleum Institute (API) Recommended Practices 13B-1, and 13B-2.

In view of the foregoing, an improved method for accurately and efficiently measuring such above-described fluid flow parameters in situ would be highly beneficial, particularly with regard to return drilling fluid.

DEFINITIONS

Certain terms are defined throughout this description as they are first used, while certain other terms used in this description are defined below:

A "flow line," as defined herein, refers to the pipe (usually) or trough that conveys drilling fluid from the rotary nipple to the solids-separation section of the drilling fluid tanks on a drilling rig.

"Drilling fluid," also known as "drilling mud" and as defined herein, refers to any liquid or slurry pumped down a drill string and up the annulus of a wellbore to facilitate drilling.

"Return (drilling) fluid," as defined herein, refers to drilling fluid, together with any solids/influxes, carried out from a wellbore.

"Dynamic level," as defined herein, refers to variability in the fluid level of the return fluid in a flow line.

A "tubular conduit," as defined herein, is a means for transporting or channeling a fluid. While the tubular conduit is typically cylindrical, it could also be rectangular or irregular in shape. Additionally, it can even be open on the top, as in a trough.

SUMMARY OF THE INVENTION

So as to overcome the above-mentioned limitations found in the prior art, the present invention is generally directed to the in situ measurement of fluid density and/or flow rate in tubular conduits, wherein such measurement comprises measuring dynamic fluid level and/or load (weight) in a measuring region (i.e., section) of the conduit and correlating these measurements of the fluid with a density and/or flow rate. Such measurements are typically directed toward drilling fluids transported within the tubular conduits—particularly the return flow, wherein the fluid comprises extraneous material (e.g., cuttings, etc.) which can alter the density and flow rate of the drilling fluid.

In some embodiments, the present invention is directed to methods for determining flow rate of a fluid (e.g., a drilling fluid) flowing through a tubular conduit (typically having a substantially uniform inner wall geometry along its length), the methods comprising the steps of: (a) measuring the level of the fluid flowing within the tubular conduit; (b) characterizing the inner wall geometry of the tubular conduit; and (c) combining the measured fluid level and the characterized inner wall geometry to determine the flow rate of the fluid flowing through the tubular conduit. Typically, such methods further comprise the steps of: (d) measuring, continuously or at any instant or frequency, the weight of fluid flowing through a section (region) of the tubular conduit, the section having a given length; and (e) combining the measured fluid weight with the determined fluid flow rate and the given section length to determine the density of the fluid flowing through the tubular conduit. Typically, the fluid is a drilling fluid and the measuring is carried out on the return flow which comprises extraneous material such as cuttings, etc. The variability of such extraneous content makes modeling such fluid difficult.

In some or other embodiments, the present invention is directed to apparatus for determining, in situ, flow rate and density of a fluid (e.g., a drilling fluid) through a tubular conduit, the apparatus comprising: (a) a measuring region of the tubular conduit that is substantially isolatable from other regions of the tubular conduit in a gravimetric manner; (b) a plurality of detectors operable for detecting fluid level within the measuring region of the tubular conduit; and (c) a plurality of load cells operable for measuring load and for ascertaining fluid weight within the measuring region of the tubular conduit.

BRIEF DESCRIPTION OF THE DRAWINGS

So that the above recited features and advantages of the present invention can be understood in detail, a more particular description of the invention, briefly summarized above, is provided by reference to the embodiments thereof that are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Generally, the present invention is directed to the in situ measurement of fluid density and/or flow rate in tubular conduits, wherein such measurement comprises measuring dynamic fluid level and/or load (weight) in a region of the conduit and correlating these measurements of the fluid with a density and/or flow rate. Such measurements are typically directed toward drilling fluids transported within the tubular conduits—particularly the return flow, wherein the fluid typically comprises extraneous material (e.g., drill bit cuttings, etc.) which can alter the density and flow rate of the drilling fluid. Such in situ measurement represents a significant advance over existing methods which indirectly measure the density of the return drilling fluid, and which are often inaccurate.

1. Methods

Figure 1:
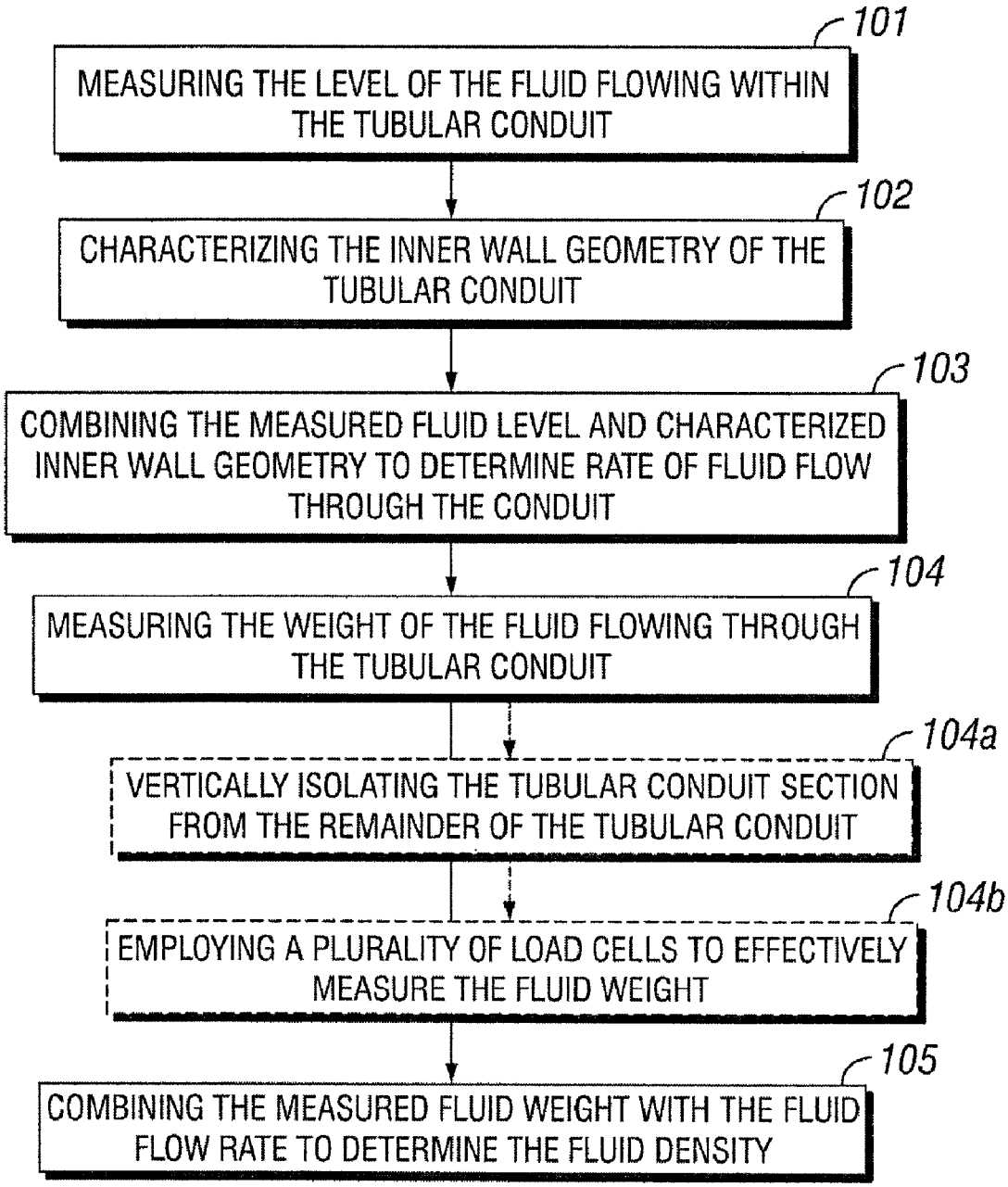
FIG. 1 depicts, in stepwise fashion, a method for determining, in situ, the flowrate and density of a fluid flowing through a tubular conduit (e.g., a pipe), in accordance with some embodiments of the present invention.

Referring to FIG. 1, in some embodiments, the present invention is directed to methods (processes) for determining flow rate of a fluid flowing through a tubular conduit (typically having a substantially uniform inner wall geometry along its length), the methods comprising the steps of: (Step 101) measuring the level (i.e., fluid height) of the fluid flowing within the tubular conduit; (Step 102) characterizing the inner wall geometry of the tubular conduit; and (Step 103) combining the measured fluid level and the characterized inner wall geometry to determine the flow rate of the fluid flowing through the tubular conduit. In some such embodiments, the inner wall of the tubular conduit is largely cylindrical and is characterized by a substantially uniform diameter.

In some such above-described embodiments, the level of the fluid flowing within the tubular conduit is determined using reflective energy transmissions, wherein such reflective energy transmissions include, but are not limited to, optical transmissions, acoustic transmissions, pressure transmissions, and combinations thereof. In other embodiments, this level is determined using mechanical and/or conductive means, as are known to those having ordinary skill in the art.

In some such above-described embodiments, the flow rate of the fluid flowing through the conduit is typically determined by calibrating fluid flow rates as a function of the tubular conduit's inner wall diameter and the level of the fluid flowing within the tubular conduit (vide infra). Typically, one or more fluids of known specific gravity (SG) are employed for such calibrating. Additionally, the total volume of the measuring region of the conduit can be determined by placing the region on a load cell, filling with water and then obtaining a temperature compensated water/volume result. This result can be stamped or otherwise identified on the outside of the conduit region and can be used for the life of the region.

Referring again to FIG. 1, in some embodiments, such methods further comprise the steps of: (Step 104) measuring, at any instant, the weight of fluid flowing through a section (region or portion) of the tubular conduit, the section having a given length; and (Step 105) combining the measured fluid weight with the determined fluid flow rate and the given section length to determine the density of the fluid flowing through the tubular conduit. In some such embodiments, the weight-measuring step comprises the substeps of: (Step 104*a*) vertically isolating (i.e., gravimetrically isolating) the tubular conduit section from the remainder of the tubular conduit; and (Step 104*b*) employing a plurality of load cells to effectively measure the fluid weight.

2. Apparatus

Figure 2A:
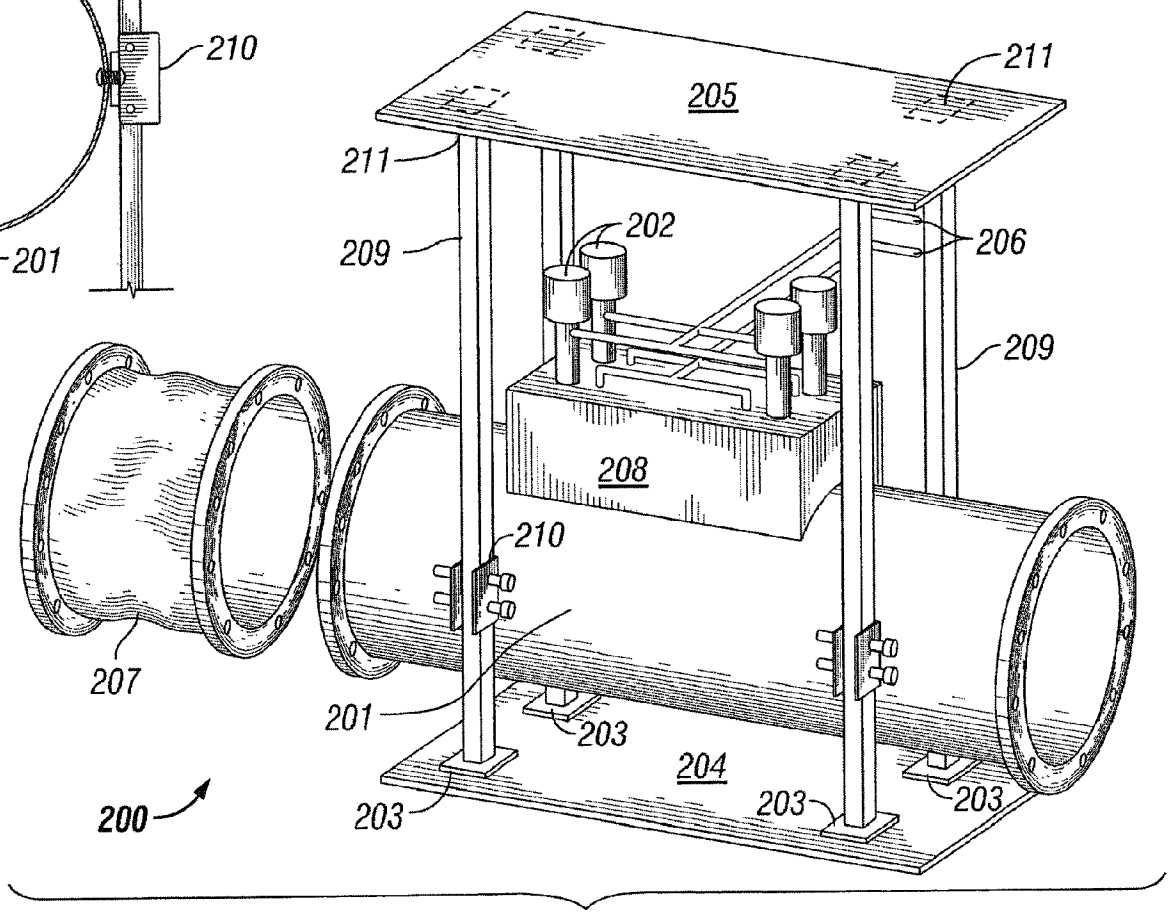
FIG. 2A illustrates an apparatus for the in situ determination of flowrate and density of a fluid flowing through a tubular conduit, in accordance with some embodiments of the present invention.
Figure 2B:
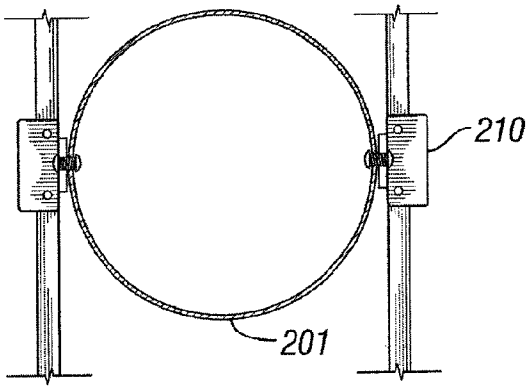
FIG. 2B is a cross-sectional view of the apparatus illustrated in FIG. 2A.

Referring now to FIG. 2, in some embodiments, the present invention is directed to an apparatus 200 for determining, in situ, flow rate and density of a fluid flowing through a tubular conduit, the apparatus comprising: a measuring region (201) of the tubular conduit that is substantially isolatable from other regions of the tubular conduit in a gravimetric manner; a plurality of detectors (202) operable for detecting fluid level within the measuring region of the tubular conduit; and a plurality of load cells (203) operable for measuring load and for ascertaining fluid weight within the measuring region of the tubular conduit. In some such embodiments, the apparatus further comprises a platform for coupling the load cells to the measuring region of the tubular conduit, wherein the platform is a support platform (204), a suspension platform (205), or a combination thereof.

In some such embodiments, purge lines (206) are used to provide a consistent path between the fluid and the detectors 202. Additionally, such purge lines can serve to protect the detectors from the drilling fluid. The measuring region 201 may be isolated from the rest of the tubular conduit via flexible couplings (207), such couplings typically being made of an elastomer. The present invention admits to other means of isolating the measuring region 201, as will be apparent to those having ordinary skill in the art. Detectors 202 and purge lines are typically coupled to the measuring region 201 via an instrument saddle (208). Similarly, load cells 203 can be coupled to the measuring region 201 via the support/suspension platform and support legs (209). Typically the measuring region 201 is attached to the support legs 209 via rotating adjusting collars (210).

In some such above-described apparatus embodiments, the plurality of detectors 202 number at least four, and suitable such detectors include, but are not limited to, laser level detectors, radar level detectors, and the like. Combinations of such detectors are also envisioned.

In some such above-described apparatus embodiments, the plurality of load cells 203 number at least four.

It will be understood from the foregoing description that various modifications and changes may be made in the preferred and alternative embodiments of the present invention without departing from its true spirit. For example, alternative load cells (211) can be positioned on suspension platform 205, as depicted in FIG. 2. Furthermore, the invention admits to numerous types of load cells as well as means other than load cells (e.g., mechanical scales) for determining the load (weight) of the measuring region of the tubular conduit.

3. Operational Description

Figure 3A:
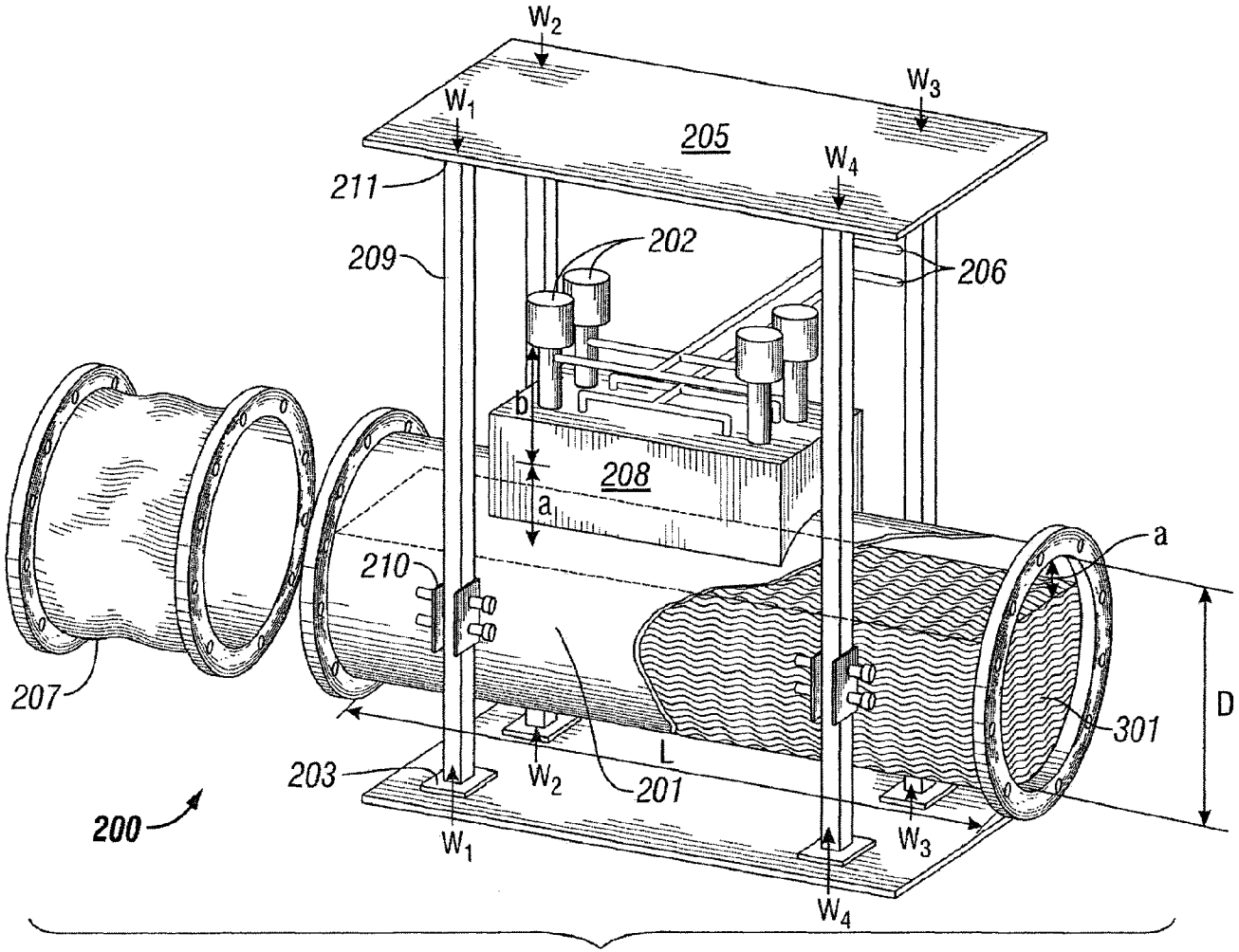
FIG. 3A is an operational view of the apparatus illustrated in FIGS. 2A and 2B.
Figure 3B:
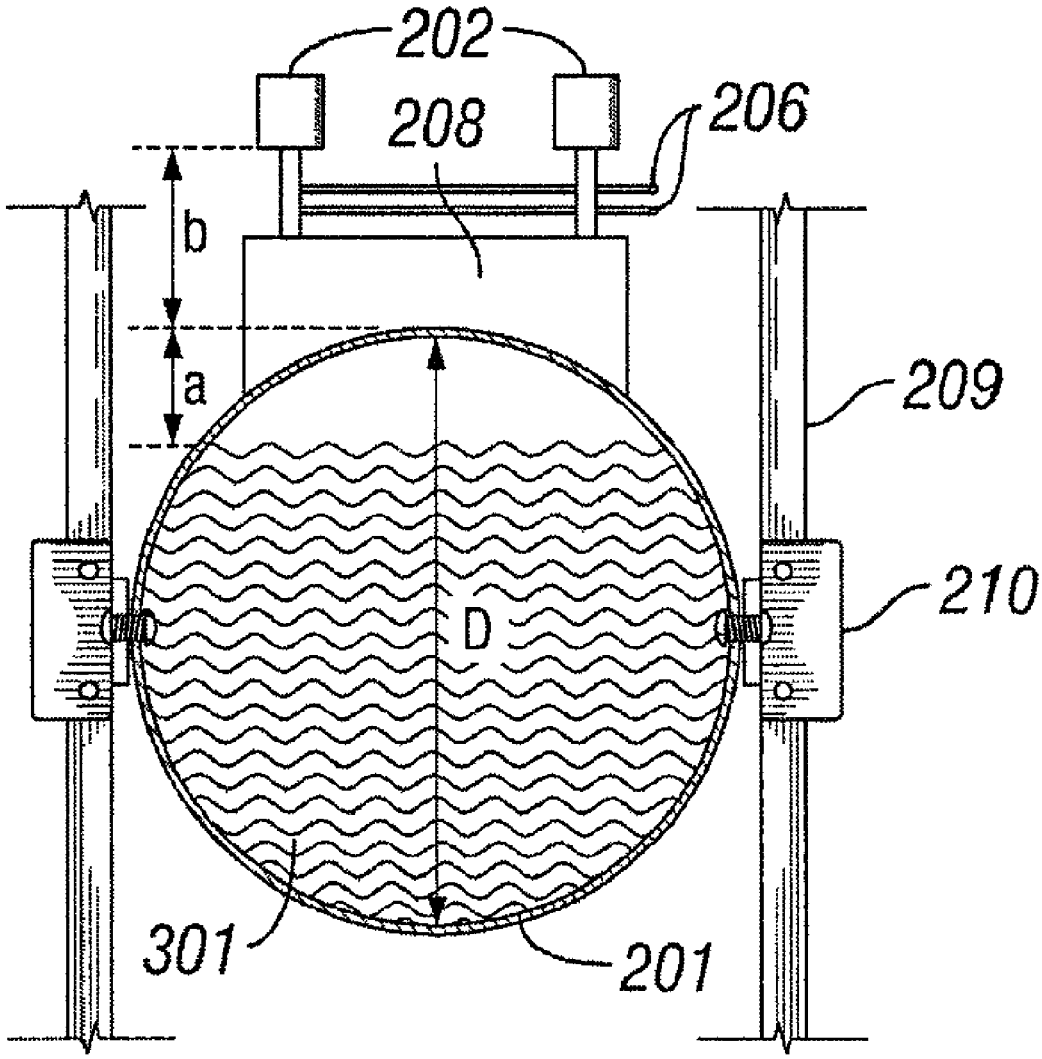
FIG. 3B is a cross-sectional view of the apparatus illustrated in FIG. 3A.

FIG. 3 depicts an operational illustration of apparatus 200, wherein a flowing fluid (301) is shown flowing through the measuring region 201 of the tubular conduit. Distance "a" is the distance between the top of the fluid 301 in measuring section 201 and the top of the tubular conduit section defining measuring section 201, such that "a" is a measure of the fluid level. Distance "b" is defined as the distance between detectors 202 and the top of the tubular conduit section defining measuring section 201. Diameter "D" is the diameter of tubular conduit section defining measuring section 201 and "L" is the length of this section. $W_1$-$W_4$ represent the loads measured by each of the four load cells 203 depicted in FIG. 3. Note that for a given measuring section, L, D, and b are all fixed parameters, whereas "a" is variable.

To calculate weight in the measuring region 201, the individual loads measured by load cells 203 are added. Therefore, for four load cells, $W_{sum}=W_1+W_2+W_3+W_4$. While the total volume ($V_t$) within the measuring section 201 is given by $V_t = \pi(D^2/4)L,$ the dynamic volume $V_{Dynamic}$ is given by the integral relation $$V_{Dynamic} = \int_0^D \pi((D-a)^2/4)Lda$$

where, because "a" is directly proportional to the flow rate with appropriate calibration, flow rate can be determined for any "a," the parameter so measured. The other measured parameter, $W_{sum}$, can be used with $V_{Dynamic}$ to determine density, ρ, via the expression:

$$\rho = W_{sum}/V_{Dynamic}$$

While FIG. 3 shows a relatively level measuring section 201, the section need not be level and is typically not level. Depending on the embodiment, aforementioned methods and apparatus can account for the measuring section being tilted or otherwise unlevel.

Additionally, in some embodiments, an understanding of the difference in flow rate and/or density between drilling fluid pumped into a wellbore and the return drilling fluid can be used for operational advantage.

4. Example

The following example is provided to demonstrate particular embodiments of the present invention. It should be appreciated by those of skill in the art that the methods disclosed in the example which follows merely represent exemplary embodiments of the present invention. However, those of skill in the art should, in light of the present disclosure, appreciate that many changes can be made in the specific embodiments described and still obtain a like or similar result without departing from the spirit and scope of the present invention.

EXAMPLE

This Example serves to illustrate how the apparatus/method can be calibrated and still account for variations in the geometry of the flow line over time, in accordance with some embodiments of the invention. Such variations can alter the distance the sensor is set from the inside bottom of the flow line, and therefore a method to calibrate/compensate for these changes is useful. Such geometry variations can be due to mechanical warping of the flow line and/or due to deposition of foreign material in the flow line.

The calibration/compensation method mentioned above would typically be done after the full set-up of the flow line was complete. The load cells would be "Zeroed" and the depth measuring device(s) (i.e., detectors) would be activated and depth measured. Once this was done, water (SG of 1) would be pumped through at a known flow rate. This procedure would then be repeated two or more times, increasing the flow rate each time. Taking note of the flow rate each time is crucial. The weight and the depth from the sensors would be captured at each flow rate. Once completed, the results can be plotted to form a calibration curve. The integrated result would normalize any distortion that might have happened between set-ups. By then repeating the above calibration sequence with the drilling fluid being used in the drilling process another calibration curve could be created giving an even tighter result. This calibration could be used as a stable value for the full term of the set-up. An added feature of zeroing the load cells during times when the mud pumps have been stopped and no flow is passing through the flow line, is compensation for, and splatter from, the mud that might have stuck to the inside of the flow line during the previous period of operation.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open set or group. Similarly, the terms "containing," having," and "including" are all intended to mean an open set or group of elements. "A," "an" and other singular terms are intended to include the plural forms thereof unless specifically excluded.

What is claimed is:

1. A method for determining flow rate and density of a return drilling fluid flowing through a tubular conduit, the method comprising the steps of:

a) measuring, within a section of the tubular conduit, the fluid level "a," corresponding to the distance from the fluid surface to the top of the tubular conduit, to determine a dynamic volume for the fluid flowing through said section, wherein said section of tubular conduit is defined by a diameter "D" and a length "L," and wherein said dynamic volume "$V_{dynamic}$" is arrived at via the following eguation:

$$V_{dynamic} = \int_0^D \pi((D-a)^2/4)Ldda;$$

b) correlating the dynamic volume so determined with a flow rate via calibration methods;

c) measuring, at any instant, the weight of fluid flowing through said section of the tubular conduit; and d) combining the measured fluid weight "$W_{sum}$" with the determined dynamic volume to determine the density "ρ" of the fluid flowing through the tubular conduit via the following relationship:

$$\rho = W_{sum}/V_{dynamic}.$$

2. The method of claim 1, wherein the section comprises a characterized, substantially-cylindrical geometry.

3. The method of claim 2, wherein the inner wall of the tubular conduit is characterized by a substantially uniform inner wall geometry along its length.

4. The method of claim 2, wherein the inner wall of the tubular conduit is characterized according to a flow calibration technique.

5. The method of claim 1, wherein the weight-measuring step comprises the steps of:

a) gravimetrically-isolating the section of the tubular conduit from the remainder of the tubular conduit via flexible couplings; and b) employing a plurality of load cells to effectively measure the fluid weight within the isolated section.

6. The method of claim 1, wherein the level of the fluid flowing within the tubular conduit is determined using reflective energy transmissions.

7. The method of claim 6, wherein the reflective energy transmissions comprise energy transmissions selected from the group consisting of optical transmissions, acoustic transmissions, pressure transmissions, and combinations thereof.

8. An apparatus for determining, in situ, flow rate and density of a fluid through a tubular conduit, the apparatus comprising:

a) a measuring region of the tubular conduit that is substantially isolatable from other regions of the tubular conduit, in a gravimetric sense, via flexible couplings;

b) one or more detectors operable for detecting fluid level within the measuring region of the tubular conduit; and c) one or more load cells operable for measuring load and for ascertaining fluid weight, as a measured fluid weight "$W_{sum}$", within the measuring region of the tubular conduit, wherein said measuring region and said one or more detectors enable measuring, within a section of the tubular conduit, the fluid level "a," corresponding to the distance from the fluid surface to the top of the tubular conduit, in order to determine a dynamic volume for the fluid flowing through said section, wherein said section of tubular conduit is defined by a diameter "D" and a length "L," and wherein said dynamic volume "$V_{dynamic}$" is arrived at via the following equation:

$$V_{dynamic} = \int_0^D \pi((D-a)^2/4)L\,da,$$

and correlation of this dynamic volume with a flow rate via calibration methods; and wherein the one or more load cells enable the determination of fluid density through a combining of the measured fluid weight "$W_{sum}$" with the determined dynamic volume to determine the density "ρ" of the fluid flowing through the tubular conduit via the following relationship:

$$\rho = W_{sum}/V_{dynamic}.$$

9. The apparatus of claim 8, further comprising a platform for coupling the load cells to the measuring region of the tubular conduit, wherein the platform is selected from the group consisting of a support platform, a suspension platform, and combinations thereof.

10. The apparatus of claim 8, wherein the one or more detectors number at least four.

11. The apparatus of claim 8, wherein the detectors are selected from the group consisting of laser level detectors, radar level detectors, and combinations thereof.

12. The apparatus of claim 8, wherein the one or more load cells number at least four.

13. The apparatus of claim 8, wherein the fluid is a drilling fluid.

14. The apparatus of claim 13, wherein the fluid is a return drilling fluid comprising extraneous components generated by downhole drilling operations.

* * * * *